United States Patent [19]

Wallace

[11] Patent Number: 4,953,344

[45] Date of Patent: Sep. 4, 1990

[54] PACKAGING FIBRE BATTS

[75] Inventor: Keith Wallace, Corunna, Canada

[73] Assignee: Fiberglas Canada Inc., Canada

[21] Appl. No.: 52,724

[22] Filed: May 20, 1987

[30] Foreign Application Priority Data

Jun. 6, 1986 [GB] United Kingdom ..... 8613760

[51] Int. Cl.[5] ..... B65B 1/24; B30B 15/06

[52] U.S. Cl. ..... 53/528; 100/295

[58] Field of Search ..... 53/523, 526, 527, 528, 53/529, 540; 100/3, 295, 297

[56] References Cited

U.S. PATENT DOCUMENTS

| | | | |
|---|---|---|---|
| 2,674,535 | 4/1954 | Meisler | 53/438 X |
| 2,982,063 | 5/1961 | Coleman et al. | 53/528 X |
| 3,195,445 | 7/1965 | Meisler | 100/295 |
| 3,228,166 | 1/1966 | Thiele | 100/3 |
| 3,908,539 | 9/1975 | O'Brien | 53/529 X |
| 4,341,056 | 7/1982 | Leanna et al. | 53/529 |
| 4,408,438 | 10/1983 | Rewitzer | 53/528 X |
| 4,738,078 | 4/1988 | Benz et al. | 53/528 X |

FOREIGN PATENT DOCUMENTS

| | | | |
|---|---|---|---|
| 0757192 | 3/1971 | Belgium | 53/441 |
| 0014923 | 9/1980 | European Pat. Off. | 53/526 |

*Primary Examiner*—Robert L. Spruill
*Assistant Examiner*—Beth Bianca
*Attorney, Agent, or Firm*—Lerner, David, Littenberg, Krumholz & Mentlik

[57] ABSTRACT

For applying a covering to glass fibre insulation batts, the batts are deposited in succession into a vertically elongate batt stacking space to form a stack of the batts, and upper and lower compression plates each having a concave compression surface the shape of which compression surfaces correspond at least substantially to the shapes of convex upper and lower surfaces of the package, are displaced vertically by an amount sufficient to compress the stack between the upper and lower compression surfaces with a compression ratio of 6:1 to 11:1. A covering of flexible sheet material is then provided around the compressed stack to maintain the stack in a compressed state. The concave compression surfaces make possible a higher compression of the batts than was possible with the flat compression plates used in the prior art, without damaging the batts and therefore while allowing satisfactory recovery of the batts when released from their compressed state.

15 Claims, 8 Drawing Sheets

PACKAGING FIBRE BATTS

FIELD OF THE INVENTION

The present invention relates to a method of and apparatus for applying a covering to glass fiber batts.

DESCRIPTION OF THE PRIOR ART

Glass fiber insulation batts are conventionally sold in prepackaged and compressed stacks of batts, which are compressed at compression ratios of between 3:1 and 5:1 and contained in plastic bags, which retain the batts in their compressed state.

Furthermore, for bulk transportation, groups of the bags are often further compressed into bales, providing an overall compression ratio of between 6:1 and 11:1. The second compression of the batts saves money on shipping and storage costs, but at some extra cost in extra packaging material and processing costs.

Hitherto, it has been well known to effect the packaging of such batts by compressing the batts in a stack and by then pushing the compressed stack of batts through a snout into a pre-made bag, the mouth of which is held open by the mouth of the snout through which the compressed batts enter the bag.

This technique is employed, for example, in the apparatuses and methods taught by Canadian Patent No. 952,495, issued Aug. 6, 1974 to Gilles L. Vachon; Canadian Patent No. 1,081,186, issued July 8, 1980 to Theodore E. O'Brien; U.S. Pat. No. 4,099,363, issued July 11, 1978 to Nikolai K. Eistinghousen et al. and U.S. Pat. No. 4,094,130, issued July 13, 1978 to Norman Kelly et al.

More particularly, the aforementioned prior patents each describe an apparatus in which batts are transported downwardly through a batt stacking space on a platen, on which the batts are assembled into a stack by dropping the batts vertically from a batt accumulator mechanism overlying the batt stacking space. When the platen approaches the bottom of a batt stacking space, the platen is withdrawn laterally from the space and recycled to the top of the space, which is reenters and down which it then travels to compress the batts in a compression space. The thus-compressed batts are laterally ejected in their compressed state through a snout into a bag, as described above.

From the aforementioned prior patents, it is also known to firstly compress a first portion of a stack, and thereafter to compress the remainder of the stack and to unite the compressed first portion and the compressed remainder, in order to reduce the overall height of the apparatus employed for assembling and compressing the stack of the batts, prior to the insertion of the stack in its compressed condition into a bag.

Other patents which disclose the use of snouts through which compressed batts are rammed into bags include U.S. Pat. No. 4,501,107, issued Feb. 26, 1985 to Tony S. Piotrowski, and U.S. Pat. No. 4,182,237, issued Jan. 8, 1980 to Theodore E. O'Brien.

In these prior batt compression and bagging apparatuses, the stacks of batts are compressed between flat compression surfaces prior to being ejected through the snout. The batts expand somewhat within their bag after leaving the snout and consequently the finished bag of batts assumes a configuration having slightly convex top and bottom faces, the batts being subjected to an initial compression between the compression plates and, subsequently, portions of the batts being subjected to additional compression or slight expansion at the bagging stage.

This additional compression of the batts and the forcing of the batts through the snout by the ram into the bag, and also the expansion of the batts within the bag, as described in greater detail below, frequently result in damage to the batts.

Furthermore, the compression of the batts is necessarily limited in practice, and in accordance with the numbers and sizes of the batts, in order to ensure that when the batts are eventually released from their package at their point of use and thus allowed to expand from their compressed state, the batts can expand sufficiently to regain or recover sufficient of their original thickness, i.e. their thickness prior to compression.

Consequently, the compression ratio employed for the compression of the batts between the compression plates has hitherto been limited in order to avoid or at least reduce damage to the batts and to permit sufficient recovery of the batts when they are unpackaged. More particularly, it has hitherto been conventional to provide bags of glass fiber insulation batts in which the batts are compressed with the package compression ratio of 3:1 to 5:1, as indicated above. Consequently, the number of batts which can be accommodated in a bag of a given size is correspondingly limited.

As also mentioned above, the bagged or packaged stacks of batts are further compressed into bales to provide an overall compression ratio of between 6:1 and 11:1, which of course necessitate a separate operation and thus increases costs and processing times.

A further disadvantage of the above-described prior art glass fiber insulation batt packaging or bagging machines was that the throughput of such machines, i.e. the initial bagging of the batts, was restricted to an undesirably low rate. More particularly, it was found in practice that as the throughput of such machines was increased, problems arising from misalignment of the batts in the batt compression space and from increased vibration, and consequential wear, which occurred as a result of the correspondingly higher speeds of operation of the machines, and thus the reliability of the operation of these machines at these higher speeds, effectively limited the maximum speeds at which the machines could be operated. The need for increased productivity indicated that such speed limitations should be overcome.

It has also previously been proposed to package compressible products in a compressed condition other than by forcing such products through a snout into a bag. For example, U.S. Pat. No. 3,246,443, issued Sept. 7, 1961 to C. O. Slemmons teaches a method and apparatus for packaging foam cushion material in which the material is compressed in a suitable press comprising a bed and a movable platen 18 with sheets of thermoplastic, air impervious material such as polyethylene, polyvinylchloride, etc. being interposed between the top and bottom of the foam cushion material and the bed and platen. When the press is closed, these sheets are heat sealed to one another around the periphery of the compressed foam cushion material to form a covering retaining the latter in its compressed state. The bed and the movable platen taught by this prior patent are both flat and no information is given with respect to the compression ratios employed.

U.S. Pat. No. 2,765,838, issued Oct. 9, 1956 to G. H. Brown, teaches apparatus packaging a group of fibrous mats or batts, made for example of glass fiber, by placing a stack of the fibrous mats upon a first sheet of paper on a conveyor flight supported by a reinforcing plate, placing a further sheet of paper on the top of the stack of fibrous mats and then compressing the stack by downward movement of a platen against the top of the stack, the edge portions of the sheets of paper being folded and adhered together to enclose the compressed stack. Once again, flat surfaces are employed for compressing the product and no information is provided as to the compression ratios employed.

The teachings of the above-mentioned U.S. Pat. Nos. 3,246,443 and 2,765,838 do not, however, take into account or counteract the damage which can occur to glass fiber insulation batts when such batts are bagged while in a state of compression which is substantially higher than has conventionally been employed hitherto.

More particularly, it is found in practice that when glass fiber insulation batts are compressed to a substantially higher degree than is usual in the art, and then bagged, not only do the above-described batt recovery problems arise but also damage to the batts occurs at the longitudinal edges of the batts as a result of the increased tension in the sheet material of the bag.

Thus, when the batts are compressed to a high degree, bagged and subsequently released from the bagging machine, some expansion of the batts within their bag occurs. This expansion causes the bag material to be tensioned at the top and bottom of the bag, consequently, the batts are able to expand further intermediate their longitudinal edge portions than at their longitudinal edges, into a convex shape at the top and the bottom of the bag, so that the longitudinal edges of the batts are unduly compressed and distorted.

This undesirable and harmful effect arises as a consequence of the use of flat compression surfaces to effect the compression of the batts as taught, for example, in the above-mentioned U.S. Pat. Nos. 3,246,443 and 2,765,838.

BRIEF DESCRIPTION OF THE INVENTION

The inventor has now found that a substantial improvement in the packaging of glass fiber insulation batts is obtained by employing, in place of the flat compression surfaces employed by the prior art, a pair of compression surfaces which are recessed, preferably in a curved manner, so as to at least approximate in a complimentary manner to the convexly curved shapes of the corresponding surfaces of the finished batt package or its bag.

More particularly, it has surprisingly been found that employing these novel recessed compression surfaces to effect the compression of the stack of batts the compression ratio utilized for such compression can be substantially increased, thus correspondingly reducing the size of the batt package for a given amount of batt material or enabling a larger amount of batt material to be included in a package of a given size, while avoiding the above-described damage to the batts caused by the use of flat compression surfaces and, consequently, permitting sufficient recovery of the batt dimensions, and in particular the batt thickness, when the batts are unpackaged.

The expression "compression ratio" as employed herein means the total nominal thickness of the batts, divided by the compressed height of the batts, and the nominal thickness is the thickness which the batts are inclined to assume when released from their package, and which is less than the thickness of the batts prior to the packaging thereof. Also, the "compressed height of the batts" refers to the height of the finished package, if the compression ratio referred to is that of the package, and to the spacing between the flat upper and lower compression surfaces, when the stack is fully compressed therebetween, if the compression ratio referred to is that which is produced by the machine.

As will be apparent from the above description of the fact that the batts expand after leaving the snout, the compressed height of the batts in the package or bag is greater than the compressed height corresponding to the spacing of the compression surfaces when the stack is fully compressed therebetween and, therefore, the compression ratio in the latter case is greater than the package compression ratio.

More particularly, it will be appreciated that the greater the compression of the batts in the machine, the greater will be the damage to the batts. By employing the recessed compression surfaces taught by the present invention, the compression ratio in the machine required to produce a predetermined package compression ratio is less than that required to produce the same predetermined package compression ratio employing flat compression surfaces instead of the presently proposed recessed compression surfaces.

Thus, by forming the upper and lower surfaces of the compressed stack with convex shapes, it is found that the amount of damage caused by the compression of the stack and by the subsequent slight expansion of the stack against its covering bag of plastic material, upon release of the bagged stack from a batt packaging machine, is substantially less, in relation to the package compression ratio, than was possible with the flat compression surfaces utilized in prior art batt packaging machines. Consequently, a higher package compression ratio than was feasible hitherto may be employed.

It is accordingly an object of the present invention to provide a novel and improved apparatus and method for applying a covering to glass fiber batts which enable higher compression ratios than hitherto to be employed for the compression of the glass fiber mats without unduly damaging the mats.

It is a further object of the present invention to employ concave compression surfaces for exerting pressure on the top and bottom of the stack of glass fiber insulation batts to compress the stack in such a way that the top and bottom of the compressed stack conform at least approximately to the convex top and bottom of the finished glass fiber insulation batt package.

It is a still further object of the present invention to enable glass fiber insulation batts to be packaged at a higher rate, and into a more compact package, that has been possible with prior art techniques.

It is a still further object of the present invention to enable a greater compression of a stack of glass fiber insulation batts to be achieved in a single compression operation that has been possible in practice hitherto.

It is another object of the present invention to enable a greater number of glass fiber insulation batts to be compressed into a package of predetermined size than has previously been possible.

It is yet another object of the present invention to enable glass fiber insulation batts to be more highly compressed into a package, without damage to the batts and will still enable an acceptable recovering of the batts from their compressed state upon release from the package, then has been possible hitherto.

It is also an object of the present invention to enable the use of a snout and a ram for driving compressed batts through the snout, and the consequential damage to the batts, which have been common hitherto in the packaging of glass fiber insulation batts, to be avoided.

According to the present invention, there is provided a method of applying a covering to glass fiber batts, comprising the steps of supplying the batts in succession to the top of a vertically elongate batt stacking space, forming a stack of the batts in the space, supporting the stack on a lower compression surface, locating an upper compression surface above the stack, the upper and lower compression surfaces each having a concave shape, compressing the stack between the upper and lower compression surfaces by relative vertical displacement of the upper and lower compression surfaces and thereby utilizing the concave shapes of the upper and lower compression surfaces to form the compressed stack with convex upper and lower stack surfaces which are at least substantially similar in shape to corresponding convex upper and lower surfaces of the package, the relative vertical displacement being sufficient to effect the compression of the stack with a compression ratio of 6:1 to 11:1, and providing a covering of flexible sheet material around the compressed stack to maintain the batts in a state of compression.

The utilization of the upwardly concave lower compression surface and the downwardly concave upper compression surface, and the consequential compression of the stack so that the compressed stack has convex upper and lower surfaces which are at least substantially similar in shape to the upper and lower surfaces of the package, enable a larger number of batts to be packaged in a single package, and at a higher throughput rate, then has been possible hitherto.

In this connection, it is particularly pointed out that the use of compression surfaces which are concave results in the compressed shape of the batts between these surfaces being much closer to the shape of the finished package than would be the case if flat compression surfaces were employed for this purpose, as in prior art batt packaging apparatuses. Consequently, for a given size of package, the convex compression surfaces taught by the present invention provide the advantage that they enable more batt material, i.e. a larger number of batts and/or batts of a greater thickness, to be accommodated in the package, than was possible with the prior art flat compression plates previously employed for compressing the batts. This advantage results from the fact that the use of the concave compression surfaces avoids damage to the batts while still allowing satisfactory recovering of the batts from their compressed state when the batts are released from the package, and subject the insulation batts to less damage than is the case, as described above, with the flat compression surfaces utilized in prior art batt packaging machines. Alternatively, for a given package size the present convex compression surfaces enable a larger number of batts to be accommodated.

While the present method may be employed in conjunction with a snout through which the compressed stack of batts is rounded into a bag, as in the above-described prior art methods and machines, this requires the stack to be compressed by an amount, equal to the thickness of the walls of the snout, which is greater than would otherwise be necessary. It is therefore preferred to avoid the use of a snout by forming the covering around the stack while the stack is compressed between the compression surfaces and then releasing the compressed stack to allow the batts to expand against the covering. This can be achieved by locating upper and lower sheets of flexible material between the stack and the upper and lower compression surfaces prior to the compression of the stack and sealing together edge portions of these sheets to form the covering while the stack is held in compression by the upper and lower compression surfaces By thus forming the covering around the compressed stack, the shearing scuffing of the compressed stack which previously occurred as it was rammed through the prior art snout are avoided.

The present method also provides the advantage that the above-mentioned second compression of the batts by compressing groups of bags or batt packages into bales, and the consequential substantial damage to the batts which is found to occur in practice during such second compression may be eliminated entirely by simply unitizing batt packages, formed in accordance with the present invention, into bales without compression of the packages.

The present invention further provides apparatus for applying a covering to glass fiber batts comprising a vertically elongate batt stacking space, means for depositing the batts in succession into the batt stacking space to form a stack of the batts therein, upper and lower compression means for effecting vertical compression of the stack of batts in the batt stacking space, the upper and lower compression means having concave compression surfaces having shapes corresponding at least substantially to the shapes of convex upper and lower surfaces of the package, means for effecting relative vertical displacement of the upper and lower compression means to compress the stack between the upper and lower compression surfaces and means for providing a covering of flexible sheet material around the compressed stack to maintain the stack in a compressed state upon removal of the compressed and covered stack from the apparatus.

Such shaping of the stack counteracts damage to the edges of the uppermost and lowermost batt upon expansion of the stack against its covering, as described above, and thus enables satisfactory recovery of the batts when they are eventually released from their covering and allowed to expand freely.

In a preferred embodiment of the invention, the compression surfaces are cylindrically curved with a radius of curvature of $\frac{1}{2}$W to 3W, preferably $\frac{5}{8}$W, where W is the width of the batts. In practice, this radius of curvature is preferably about $9\frac{1}{2}$ inches for batts having a width of 15 inches, and about 18 inches for batts having a width of 23 inches.

Although the concave compression surfaces are preferably curved, some advantage over prior art flat compression surfaces may be obtained by forming the compression surfaces with recesses having flat inclined sides and a curved or flat bottom.

However, as will be appreciated from the above discussion, the shapes of the top and bottom surfaces of the compressed stack of insulation batts are preferably formed so as to correspond substantially to the shapes of the corresponding surfaces of the finished package, i.e. of the shape which will be assumed by the compressed batts in their retaining covering when released from the apparatus.

In a preferred embodiment of the invention, a batt support member is mounted for horizontal displacement into and from the batt stacking space at a location near the bottom of the batt stacking space and above the lower compression means. The above support means is withdrawn from the batt stacking space at this location, upon displacement of the batts forward member into the location, in order to transverse the stack of batts from the batt support means to the batt support member.

Upper and lower sheets of covering material are then fed into the batt support space between the top of the stack and the upper compression surface, on one hand, and the batt support member and the lower compression surface, on the other hand, the latter being raised towards the batt support member and the latter then being withdrawn from the batt stacking space to deposit the stack of batts onto the lower sheet on the lower compression surface.

The upper compression surface is then displaced downwardly against the top of the stack to effect the compression of the stack in a single stroke without relaxation, in order to minimize fiber breakage.

When the compression has been completed, edge portions of the covering material sheets are sealed together at opposite sides of the compressed stack.

It will be appreciated, therefore, that the covering is preferably formed around the product in this way, in contrast to prior art techniques, in which the glass fiber insulation batts must be over-compressed and rammed through snouts into prepared bays, both of which operations involve greater damage to the product.

However, depending on the dimensions and compression of the batts, bagging of the batts may in suitable cases be effected by ramming the compressed batts through a snout into bags.

Also in the preferred embodiment of the invention there is employed an auxiliary compression means for compressing the first of the stack in the batt stacking space and for supporting the remainder of the stack for compression of the remainder of the stack by the upper compression means. When the first portion and the remainder of the stack have been equally compressed, the auxiliary compression means is removed from the stack, which is thus united.

The use of this auxiliary compression means enables the overall height of the apparatus to be reduced.

BRIEF DESCRIPTION OF THE DRAWINGS

Further features, objects and advantages of the present invention will be more readily understood from the following description of the present invention when taken with reference to the accompanying drawings, in which.

DESCRIPTION OF THE PREFERRED EMBODIMENT

Figure 1:
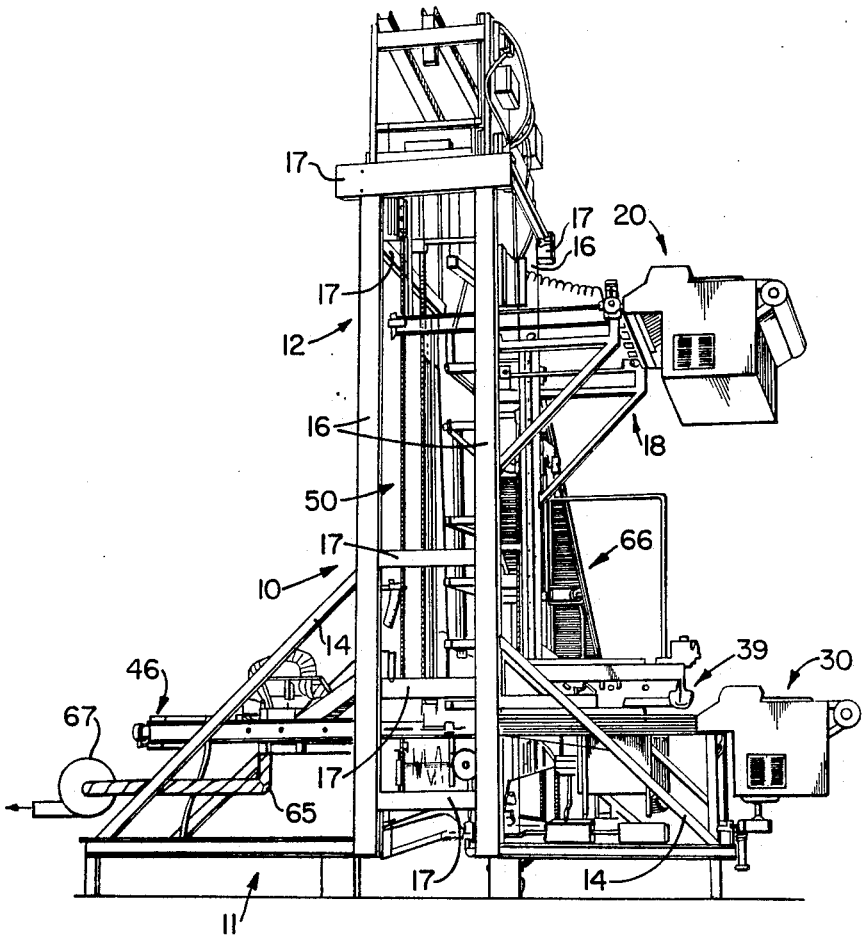
FIG. 1 shows a view in perspective of a glass fiber insulation batt compression machine according to a first embodiment of the invention.

Referring firstly to FIG. 1, there is indicated generally by reference numeral 10 a glass fiber insulation batt compression machine according to the first embodiment of the invention. The machine 10 comprises a machine bed indicated generally by reference numeral 11 on which a tower indicated generally by reference numeral 12 is supported and braced by struts 14.

The tower 12 is in the form of a framework of metal beams, comprising four vertical posts 16 which are interconnected by horizontal cross-beams 17, not all of which are shown.

A first platform indicated generally by reference numeral 18 is fixed relative to the tower 12 and carries an upper sheet feed mechanism indicated generally by reference numeral 20 (FIG. 4A), which comprises a pneumatic ram 22 carrying, on its piston, gripper jaws 24 for drawing the leading edge of a sheet material 26 from a supply roll 28 and a cutter 25 for cutting transversely across the sheet material 26.

Below the platform 18, the batt packaging machine has a lower sheet feed mechanism indicated generally by reference numeral 30, which comprises a pneumatic ram 32 having jaws 33 for gripping and advancing the leading edge of a sheet material 35 from a supply roll 38 and a cutter 36 for cutting across the sheet material 35 materials. The sheet materials 26 and 35 are polyethylene sheets.

Between the upper and lower sheet feed mechanisms 20 and 30, a carriage indicated generally by reference numeral 39 is moveable vertically along the tower 12.

The carriage 39 carries a pneumatic ram 34, which is operable to effect horizontal displacement of an intermediate compression member **36*a*. The carriage 39 can be moved to and fro vertically along the tower 12 by a drive mechanism comprising a drive motor 38 connected by a chain and pulley drive transmission indicated generally by reference numeral 40 to the carriage 39**.

Between the lower sheet feed mechanism 30 and the carriage 39, a further pneumatic ram 42 is secured to the tower 12 and serves to effect horizontal extension and retraction of a horizontal support plate 44.

Figure 4C:
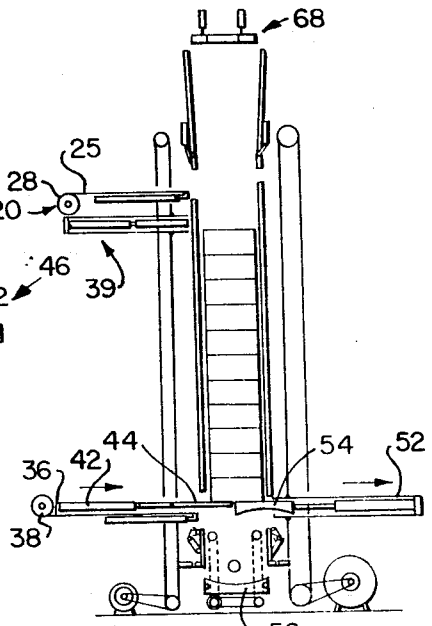
FIGS. 4A through 4I diagrammatically illustrate a sequence of successive stages of operation of the machine of FIG. 1 during the formation and covering of a stack of glass fiber insulation batts.
Figure 4B:
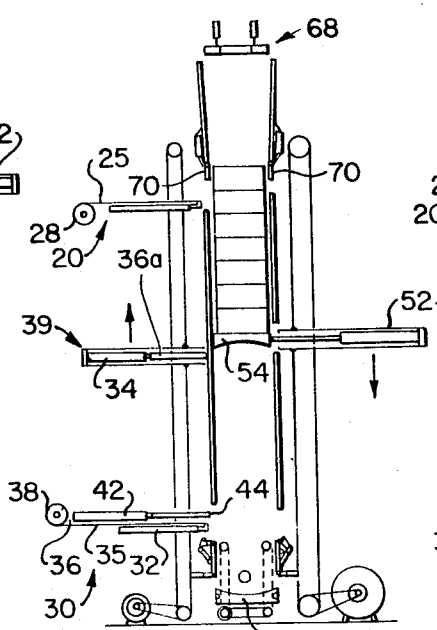
Figure 4A:
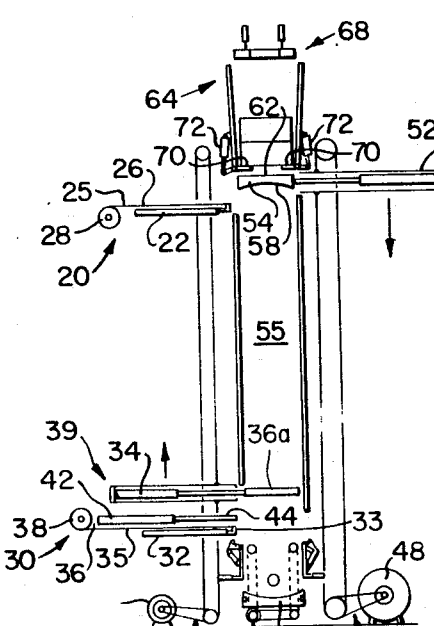

At the opposite side of the tower 12, a further carriage, indicated generally by reference numeral 46, is moveable vertically to and fro between an upper position in which it is shown in FIG. 4A and a lower position in which it is shown in FIG. 4C, by means of a drive motor 48 and a chain and pulley drive transmission indicated generally by reference numeral 50. The carriage 46 carries a pneumatic ram 52 which is operable to effect horizontal extension and retraction of an upper batt compression member indicated generally by reference numeral 54.

During the downward movement of the carriage 46, as shown in FIGS. 4A to 4C, with the upper batt compression member 54 extended, the latter travels downwardly through a batt stacking and compression space indicated generally by reference numeral 55.

At the bottom of this compression space 55 there is provided a lower batt compression member 56.

Figure 4F:
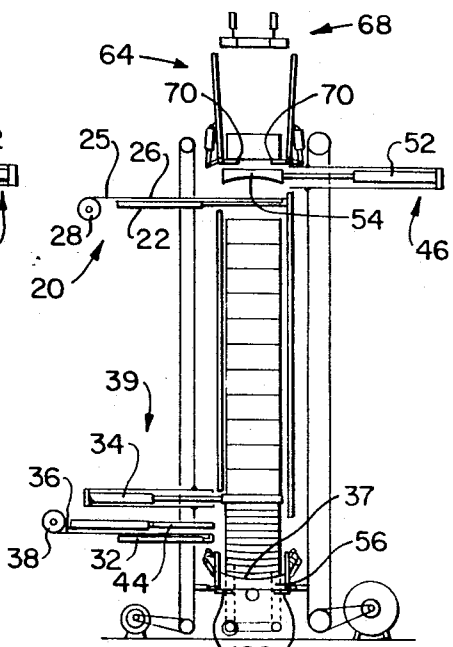
Figure 4E:
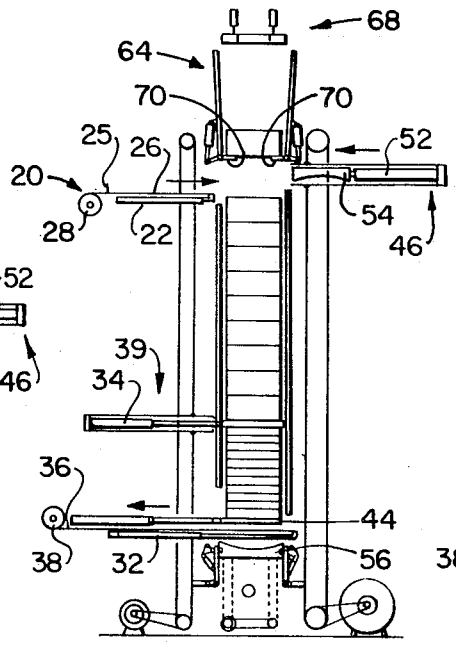

The lower batt compression member 56 is vertically displaceable, through a relatively short distance, from a lowermost position in which it is shown in FIG. 4A to an uppermost position in which it is shown in FIG. 4E by means of a drive mechanism comprising a drive motor and a chain and pulley mechanism indicated generally by reference numeral 58.

The underside of the upper batt compression member 54 is formed by the cylindrically curved, downwardly concave compression surface of a compression plate 58, and the upper surface of the lower batt compression member 56 is formed by the cylindrically curved, upwardly concave compression surface of a compression plate 60.

The upper batt compression member 54 is a hollow box having opposite flat side walls 55 (FIG. 2), formed with suction openings 57*a*, and having a top surface formed by a plate 62. The interior of this box communicates through a hollow support member 59 and a duct 61 fixed to the hollow support member 59, a gate valve 63*a* operated by a pneumatic cylinder 63*b* and a flexible duct 65 with a suction fan 67 to enable air to be sucked in through openings 57*b* in the compression plate 58.

Above the batt stacking and compression space 55, at the top of the tower 12, there is provided a batt accumulator, indicated generally by reference numeral 64, which serves to accumulate insulation batts delivered thereto by an upwardly inclined conveyor indicated generally by reference numeral 66 in FIG. 1 and deposited into the accumulator 64 by a batt loader indicated generally by reference numeral 68.

The accumulator 64 and the batt loader 68 are of conventional construction, which is well known to those skilled in the art, and which therefore will not be described in further detail herein, except to mention that the bottom of the accumulator 64 is provided with a pair of accumulator doors 70 which are pivotable between a closed position, in which they are shown in FIG. 4A, and an open position, in which they are shown in FIG. 4B, by means of pneumatic piston and cylinder devices 72. These doors 70, when in their closed position, serve to retain batts in the accumulator 64 and, when opened, release the batts so that the batts are able to fall into the stacking space 55.

Figure 3:
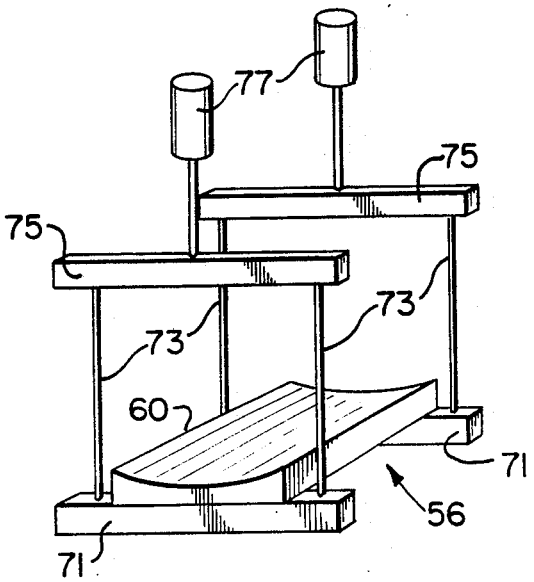
FIG. 3 shows a view in perspective of a lower batt compression member and associated pneumatic cylinders forming parts of the machine of FIG. 1.

The lower batt compression member 56 is in the form of an elongate hollow box which, as shown in FIG. 3, is supported at opposite ends on a pair of horizontal lower support beams 71, suspended by vertical bars 73 from upper horizontal support beams 75. A pair of pneumatic cylinders 77, which are mounted on the tower 12, are operable to raise and lower the beams 71 and 73 and, therewith, the lower batt compression member 56.

The shapes of the compression surfaces defined by the upper and lower compression plates 58 and 60 are of particular importance in the operation of the machine and are discussed in greater detail below. For the present, it is simply to be noted that these cylindrically curved concave surfaces substantially correspond in shape to the upper and lower convex surfaces of the insulation batt package to be produced by the machine 10.

The cycle of operation of the machine 10 is as follows.

With the carriage 46 in its uppermost position, and with the pneumatic ram 52 operated to extend the upper batt compression member 54 into its extended uppermost position, in which it is shown in FIG. 4A, and in which it underlies the accumulator doors 70 of the accumulator 64, the cycle of operation of the machine is initiated by energizing the motor 48 to displace the carriage 46 downwardly.

The upper batt compression member 54 is correspondingly displaced downwardly through the compression space 55 and, during this downward movement of the upper batt compression member 54, the accumulator doors 70 are opened, as shown in FIG. 4B, to deposit glass fiber insulation batts, indicated by reference numeral 74, onto the flat uppermost support plate 62 forming the top of the upper batt compression member 54.

In this way, there is formed on the top plate 62 a first portion of a stack of batts.

The upper batt compression member 54 descends to its lowermost position and, the pneumatic ram 52 is then operated to retract the upper batt compression member 54 and, simultaneously, the pneumatic ram 42 is operated to extend the support plate 44 horizontally into the stacking space 55 below the batts therein, so that the first portion of the stack of batts is thereby transferred from the top plate 62 of the upper batt compression member 54 to the top of the support plate 44, as illustrated in FIG. 4C.

Figure 4D:
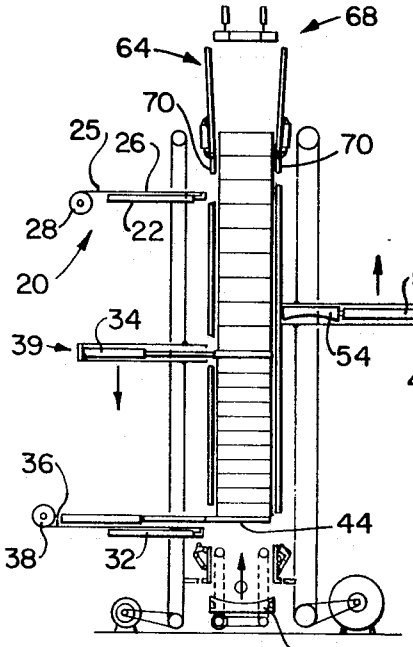

The carriage 46 is then displaced upwardly, as shown in FIG. 4D, to return to its uppermost position, as shown in FIG. 4E.

Meanwhile, the carriage 39 is raised by the motor 38 to the level of the top of the stacking space 55, the pneumatic ram 34 is operated to extend the intermediate compression member 36*a* into the stacking space 55 and the accumulator doors 70 open to deposit additional batts onto the intermediate compression member 36*a*, as also shown in FIG. 4D, the motor 38 being energized to cause the carriage 39 and therewith the intermediate compression member 36*a* to be displaced downwardly.

Consequently, the first portion of the stack of batts is compressed between the intermediate compression member 36*a* and the support plate 44, as shown in FIG. 4E.

As also shown in FIG. 4E, the accumulator doors 70 are again closed and the pneumatic ram 32 is operated as indicated by an arrow, to advance the sheet material 35 across the compression space 55 between the extended support plate 44 and the lower batt compression member 56 and the cutter 36 is operated to provide a cut lower sheet 37 on the lower compression plate 60.

Also, the lower batt compression member 56 is raised by operation of the pneumatic cylinders 77 from its lowermost position to its uppermost position, in which it more closely underlies the support plate 44, so as to minimize the distance between the bottom of the compressed batts and the compression surface of the lower compression member 56 and, thus, to counteract a misalignment of the compressed batts as the support plate 44 is retracted into its withdrawn position, in which it is shown in FIG. 4F, to allow the compressed batts to expand downwardly onto the lower batt compression member 56.

While the support plate 44 remains in its extended position and in order to avoid excessive compression of the batts between the support plate 44 and the intermediate compression member 36*a*, the latter is moved downwardly through no more than two thirds of its path of travel.

When sufficient additional batts to form a second portion of the stack which is to be compressed into a single package has been fully accumulated on the intermediate compression member 36a, the pneumatic ram 22 is operated to extend the gripper jaws 24 across the stacking space 55 and, the cutter 25 is operated to provide an upper cut sheet 41 of flexible material between the uppermost batt in the stacking space 55 and the underside of the upper batt compression member 54, which is again extended into the top of the stacking space 55 by operation of the pneumatic ram 52 as shown in FIG. 4F.

Also the lower batt compression member 56 is lowered from its uppermost position, in which it is shown in FIG. 4E, to an intermediate position, in which it is supported by lock bars 180 as shown in FIG. 4F.

By the application of suction from the interior of the upper batt compression member 54 through the openings 57b in the compression plate 58, the upper cut sheet 41 of material, which at this time is released by the gripper jaws 24, is drawn against the curved downwardly facing surface of the compression plate 58 and thereby retained against that surface while opposite edge portions of the sheet 41 are retained against the side walls 55 by suction through the openings 57a.

The pneumatic ram 22 is then operated to retract the gripper jaws 24 from the stacking space 55, and the motor 48 is operated to cause the carriage 46 to descend and, thus, to cause the upper batt compression member 54 to descend through the batt stacking space 55.

Figure 4I:
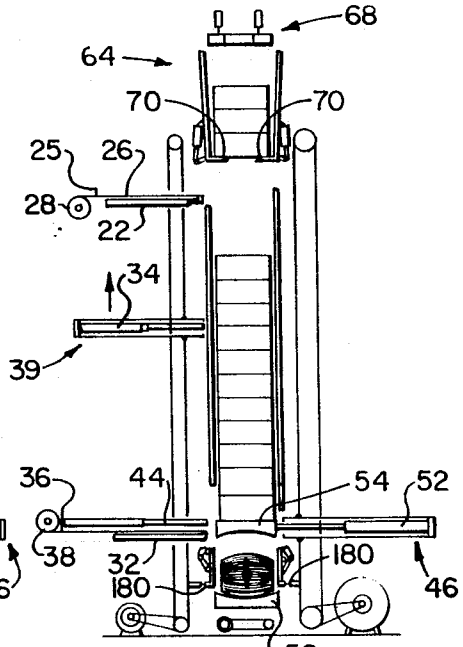
Figure 4H:
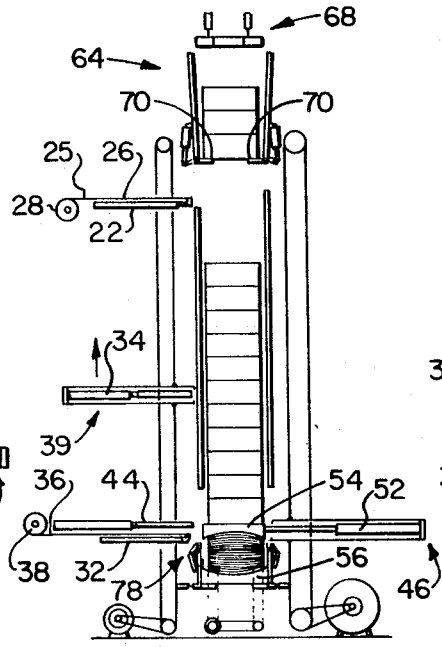
Figure 4G:
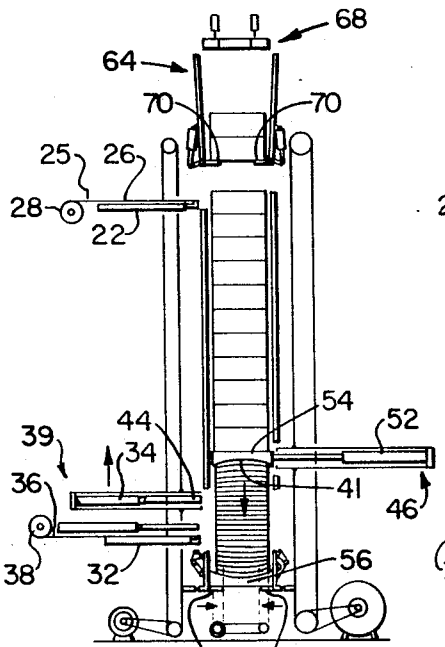

When the compression of the batts between the intermediate member 36a and the lower batt compression member 56 is substantially equal to that of the batts between the intermediate member 37 and the upper batt compression member 54, the pneumatic ram 34 is operated to retract the intermediate compression member 37, as shown in FIG. 4G, so that the batts between the upper and lower batt compression members 54 and 56 are united into a single stack with the lower batt compression member 56 still in its intermediate position.

The upper batt compression member 54 continues to descend until is reaches its lowermost position, as shown in FIG. 4H, and the lower batt compression number 56 is moved upwardly, until the compression of the batts has been completed.

Heat seal bars 78 at opposite sides of the compressed stack of batts are then operated to clamp together and to seal together marginal edge portions of the upper and lower sheets of packaging material to form a covering around the compressed stack of batts.

The upper batt compression member 54 is then raised and the lock bars 180 are withdrawn from the lower batt compression member 56, which is lowered into its lowermost position, in which it is shown in FIG. 4I, in order to release the pressure exerted thereby on the stack of batts. Consequently, the batts are thereby allowed to expand within their covering by an amount which is restricted by the covering, so that the batts are then maintained in a state of compression by the covering.

Figure 5:
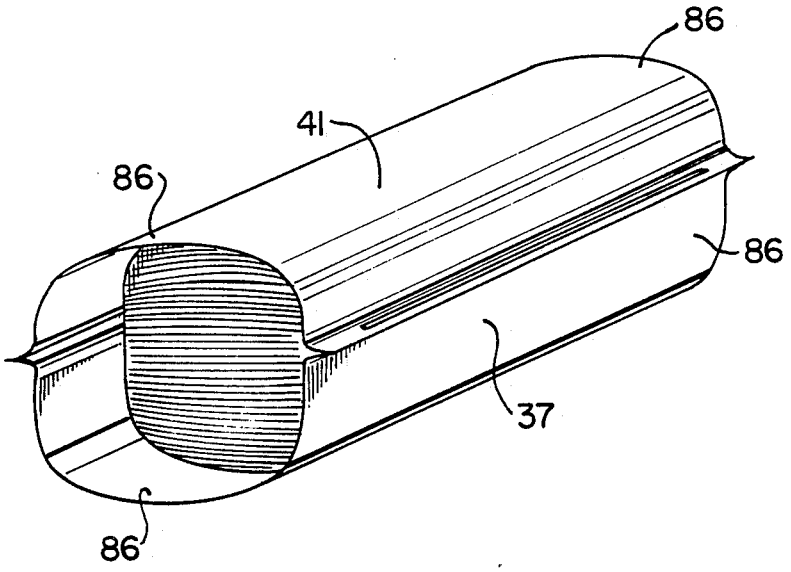
FIG. 5 shows a view in perspective of a compressed and covered stack of batts as ejected from the machine of FIG. 1 at the end of each cycle of operation thereof.

The compressed and covered stack of batts, which is indicated generally by reference numeral 80 in FIG. 5, is then ejected from the machine 10 by the operation of a ram 181 perpendicular to the plane of FIGS. 4A to 4H, and the next cycle of the operation of the machine, starting from the state shown in FIG. 4C, is initiated.

As can be seen from FIG. 5, the compressed stack of batts, indicated by reference numeral 82, is retained in its compressed state by the elongate seals, one of which is shown and indicated by reference numeral 84, connecting together the marginal edge portions of the upper and lower cut sheets 37 and 41 of packaging material, which project beyond opposite ends of the stack to form free end portions 86.

These free end portions 86 of the cut sheets 37 and 41 are collapsed and sealed at the opposite ends of the stack in a separate operation (not shown) to provide a sealed bag enclosing the stack.

By compressing initially a first portion of the total batt content of a package and then subsequently compressing the remainder of the batts to be included in the same package, the height of the stacking space 55, and thus the height of the tower 12, can be reduced as compared to what would be required to compress the entire stack of batts in a single stroke of the upper batt compression member 54.

Figure 6B:
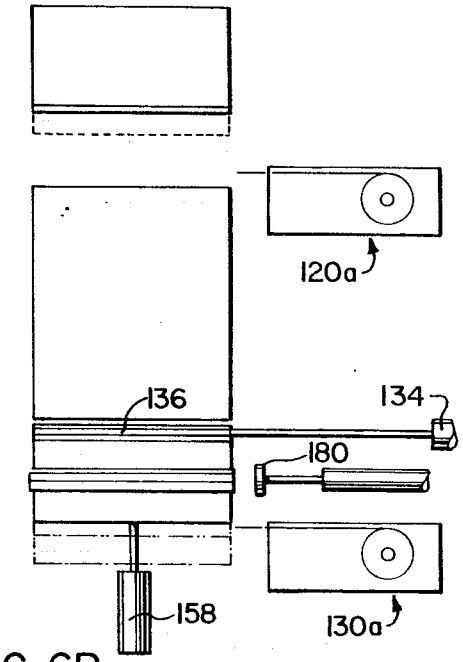
FIG. 6B shows a diagrammatic side view of the machine of FIG. 6A.
Figure 6A:
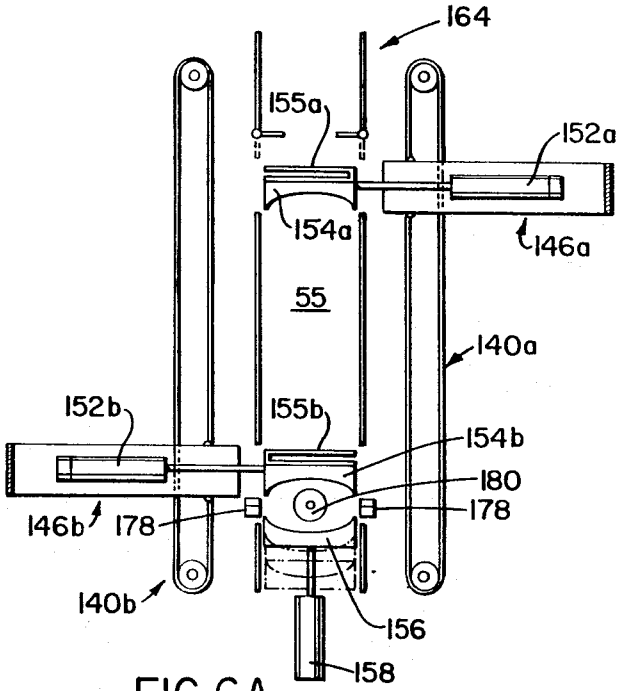
FIG. 6A shows a diagrammatic view in vertical cross-section through a batt compression machine according to a second embodiment of the invention.

FIGS. 6A and 6B diagrammatically illustrate a modification of the machine of FIG. 1.

As shown in FIG. 6A, the modified machine has, instead of a single upper batt compression member 54, two upper batt compression members, indicated by reference numerals 154a and 154b, respectively, which are displaceable to and from the stacking space 55 by respective pneumatic cylinders 152a and 152b, mounted on carriages indicated generally by reference numerals 146a and 146b, respectively. The carriages 146a and 146b are displaceable to and fro vertically by chain and sprocket drive transmissions indicated generally by reference numerals 140a and 140b, driven by respective motors (not shown).

Figure 2:
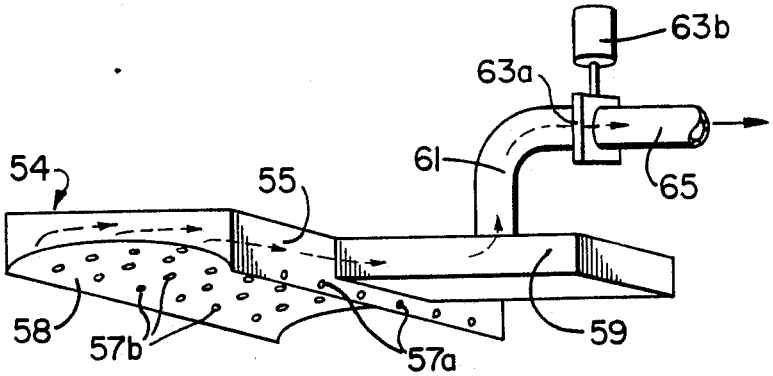
FIG. 2 shows a view in perspective of an upper batt compression member and associated duct work forming parts of the machine of FIG. 1.

Upper and lower sheet feed mechanisms 120a and 130a are, in this case, arranged to feed the sheet material along the length of the upper and lower compression members, rather than transversely, i.e. in the direction of their widths as is the case with the machine 10 of FIGS. 1 and 2.

Also, a support plate 136 is displaceable to and fro by means of a pneumatic ram 134 in the same direction as the sheet material, i.e. longitudinally of the upper and lower batt compression members. Thus, the upper and lower sheet feed mechanisms 120a and 130a and the support plate 136 do not obstruct the vertical displacement of the carriages 146a and 146b.

Also, the upper and lower batt compression members 154a and 154b are each provided with an auxiliary support plate 155a and 155b, respectively, which are each spaced above the upper batt compression members 154a and 154b by a gap which, in the case of the support plate 155a is laterally open to the left as viewed in FIG. 6A and, in the case of the support plate 155b is open to the right, also as shown in FIG. 6A, to accommodate the support plate 136 and to allow the upper batt compression members 154a and 154b to be extended into and retracted from the stacking space 55 while the support plate 136 is in its extended position, i.e. while the support plate 136 is extended into the stacking space 55.

For convenience of illustration, a pneumatic ram 158 has been shown in FIGS. 6A and 6B for raising and lowering the lower batt compression member 156.

Also, FIGS. 6A and 6B show a ram 180 which can be extended and retracted longitudinally of the batt compression members for ejecting the batt packages from this machine. It will be appreciated that other types of drives, e.g. chain and sprocket drives, may be utilized instead of the rams 158 and 180.

The modified machine further incorporates a batt accumulator indicated generally by reference numeral 164, which like the batt accumulator 64 of FIGS. 1 to 4 is of conventional construction, and sealing jaws 178 corresponding to the sealing jaws 78 of the machine 10.

In operation of this modified machine, batts are released by the batt accumulator 164 to fall into the stacking space 55 and, thereby, to form stacks on the uppermost surfaces of the supports 155*a* and 155*b*, as the upper batt compression members 154*a* and 154*b* are moved in succession downwardly through the stacking space 55.

When the upper batt compression member 154*a* reaches it lowermost position, the support plate 136 is extended into the gap beneath the support plate 155*a*, and the upper compression member 154*a* is then withdrawn laterally from the stacking space 55 to transfer its load of batts from the batt support plate 155*a* to the support plate 136.

The lower batt compression member 156 is then raised by operation of the pneumatic ram 158 to receive these batts from the support plate 136 upon retraction of the latter from the stacking space 55, and the lower batt compression member 156, now supporting thereon the above-mentioned stack of batts, is again lowered by operation of the pneumatic ram 158 into its lowermost position.

Prior to the withdrawal or retraction of the support plate 136, the lower sheet feed and cutting mechanism 130*a* is operated to provide a sheet of packaging material on the lower batt compression member 156.

The upper compression member 154*b* is then extended into the top of the stacking space 55, and the upper sheet feed and cutting mechanism 120*a* is operated to feed an upper sheet of material between the upper batt compression member 154*b* and the underlying stack of batts.

The upper batt compression member 154*b* is then caused to descend through the stacking space 155, thus compressing this stack of batts against the lower batt compression member 156. When this compression has been completed, the sealing jaws 178 are operated to seal together the marginal edge portions of the upper and lower sheets of packaging material, thus packaging the compressed batts, the upper batt compression member 154*b* is raised slightly to release the package and the ram 180 is extended to eject the package from the machine.

During its above-mentioned descent through the stacking space 55, the upper batt compression member 154*b* accumulates a second stack of batts on its support plate 155*b*. This second stack is then subsequently compressed in a like manner between the lower batt compression member 156 and the upper batt compression member 154*a* in a manner which will be readily apparent from the above description.

It will be apparent that the upper batt compression members 154*a* and 154*b* and the lower batt compression member 156 have concavely curved compression surfaces and, as will be readily apparent from the preceding description, the purpose of such curvature is to compress the stacks of batts in such a manner that upper and lower faces of the compressed stacks have convex shapes correspondingly at least approximately to the eventual shapes of the top and bottom of the package upon release of the package by the compression surfaces As described in some detail hereinabove, the advantages of the use of concavely curved compression surfaces, as in the machine 10 of FIGS. 1 to 4 and the modified machine of FIGS. 6A and 6B, over the use of flat compression plates as employed in the prior art include the possibility of employing a greater compression ratio, reduced damage to the batts, a more compact packaging and improved batt recovery at high compression ratios, in addition to increased throughput and the avoidance of unduly high machine operating speeds.

Figure 7:
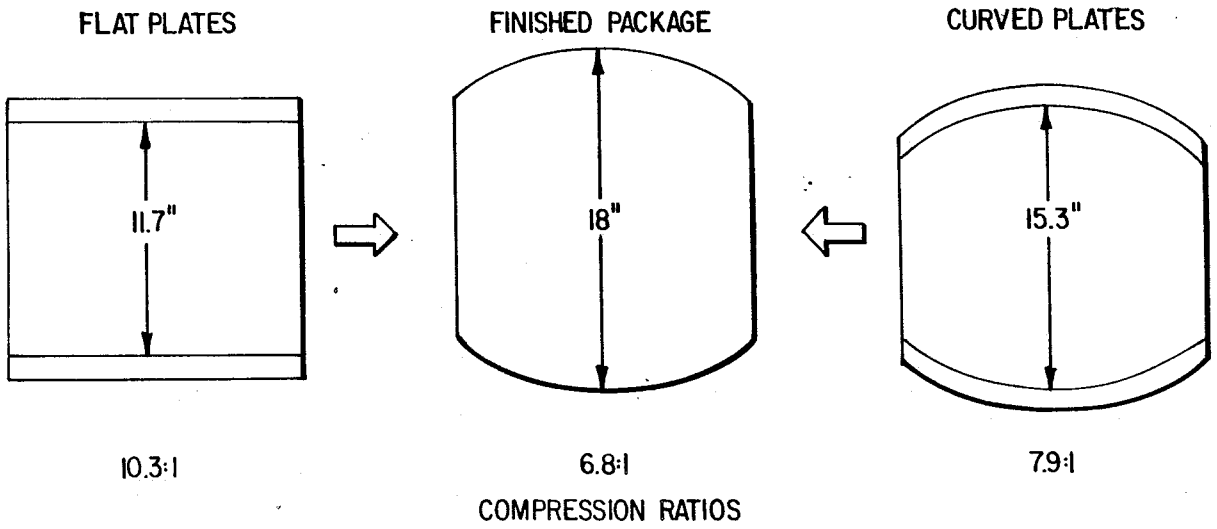
FIG. 7 diagrammatically illustrates by way of comparison the compression of batts by flat compression plates and by curved compression plates.

In this connection, reference is made to FIG. 7, which illustrates the results of an experimental comparison of the use of flat and curved plates for producing a batt package of a predetermined size.

More particularly, both types of plates were employed to produce a batt package, illustrated at the middle in FIG. 7, having a height of 18 inches and containing batts under compression with a package compression ratio of 6.8:1.

As shown to the left of FIG. 7, it is found in practice that, when employing flat plates to produce such a package, a compression ratio of 10.3:1 is required, the batts being compressed to a height of 11.7 inches.

On the other hand, employing curved plates, as illustrated at the right in FIG. 7, it was necessary to employ a compression ratio of only 7.9:1, and to compress the batts to a height of 15.3 inches at the centers of the batts, in order to produce the same package.

To minimize damage to the batts, the shapes of the compression plates should permit the minimum of distortion between the compressed shape of the stack of batts and the eventual package shape. Thus, the curvature of the plates should be substantially similar, in a complimentary manner, to the shape of the finished package.

However, to allow for some stretch in the sheet material employed for the packaging, a certain amount of over-compression of the stack of batts is required in practice, and the shapes of the compression surfaces must allow for such over-compression. Consequently, the depth of each compression surface profile should be less than ½ of the height of the compressed shape.

For example, if it is desired to produce packages having a height of 14.6 inches, then it is found that a radius of curvature of 9½ inches for the compression surfaces is suitable for batts having a width of 15 inches and 16 inches. However, an "ideal" radius of curvature of 15 inches for use with batts having a width of 23 inches and 24 inches would not permit sufficient compression to achieve a package height of 14.7 inches and, accordingly, wider compression surfaces employed for such wider batts are preferably flattened somewhat to a radius of a curvature of approximately 18 inches.

In general, the inventor has found that the shape of the compression surfaces should be that which most closely fits the curved surfaces of the finished package and which, nevertheless, permits the compression surfaces to be moved together sufficiently to provide the required amount of over-compression of the batts.

It is not essential for the compression surfaces to be cylindrically curved. Thus, for example, the compression surfaces may be curved surfaces having different radii of curvature at different points across the surfaces, and it has been found that, whether cylindrically curved or otherwise curved, the radius of curvature of the compression surfaces should not be less than ½W where W is the width of the batts, nor more then 3W, and that preferably the radius of curvature should be ⅝W.

Furthermore, the invention is not restricted to the use of compression surfaces having curved recesses therein but may be performed, for example, employing concave compression surfaces which are recessed with the shape comprising flat inclined side walls extending to a flat or curved bottom or curved side walls extending to a flat bottom, provided that the shape of the recess approximates the shape of the top and bottom of the finished batt package, as discussed above.

I claim:

1. In an apparatus for packaging batts of glass fiber material having a width W and which are adapted to be compressible and elastic in one direction but not in two directions perpendicular to said one direction, the apparatus comprising a pair of compression members, means for effecting relative displacement of said compression members to compress a stack of said batts therebetween and means for providing a covering around the compressed stack to retain said batts in a compressed state, the improvement comprising opposed concave surfaces on said compression members for forming correspondingly convex surfaces at opposite ends of said stack during the compression thereof, said correspondingly convex surfaces being at least substantially similar in shape to corresponding convex upper and lower surfaces of said covering around the compressed stack, said concave surfaces being curved surfaces having a radius of curvature of between about W/2 and about 3W, thereby facilitating compression of the stack counteracting damage to said batts during the compression thereof and promoting satisfactory recovery of said batts upon release from said covering.

2. Apparatus as claimed in claim 1, wherein said concave surfaces are curved surfaces having a radius of curvature of about $\frac{5}{8}$W.

3. Apparatus for applying a covering to glass fiber insulation batts having a width W and which are adapted to be compressible and elastic in one direction but not in two directions perpendicular to said one direction to form a package, said apparatus comprising:

a vertically elongate batt stacking space;

means for depositing the batts in succession into said batt stacking space to form a stack of the batts therein;

upper and lower compression means for effecting vertical compression of said stack of batts in said batt stacking space;

said upper and lower compression means each having a concave compression surface, the shape of said compression surfaces corresponding at least substantially to the shapes of convex upper and lower surfaces of the package;

said upper and lower compression surfaces having a radius of curvature between about $\frac{1}{2}$W and about 3W;

means for effecting relative vertical displacement of said upper and lower compression means to compress said stack between said upper and lower compression surfaces; and means for providing a covering of flexible sheet material around the compressed stack to maintain said stack in a compressed state upon removal of said compressed and covered stack from said apparatus.

4. Apparatus as claimed in claim 3, wherein said radius of curvature is about $\frac{5}{8}$W.

5. Apparatus as claimed in claim 3, wherein said upper compression means comprises a pair of upper compression members, said apparatus further comprising drive means for displacing said pair of upper compression members downwardly in succession through said batt stacking space for compressing respective successive stacks of said batts.

6. Apparatus for applying a covering to glass fiber insulation batts to form a package, comprising:

a vertically elongate batt stacking space;

batt support means within said batt stacking space, said batt support means being movable downwardly along said batt stacking space;

means for depositing the glass fiber batts in succession onto said batt support means to form a stack of the glass fiber batts on said batt support means;

means for withdrawing said batt support means horizontally from beneath said stack;

upper and lower compression means for effecting vertical compression of said stack of glass fiber batts in said batt stacking space;

said lower compression means having an upwardly concave lower compression surface for receiving said stack of batts upon the horizontal withdrawal of said batt support means from said batt stacking space and for supporting said glass fiber batts;

means for displacing said upper compression means into and from a position in said batt stacking space overlying said stack;

said upper compression means having a downwardly concave upper compression surface;

said concave upper and lower compression surfaces having shapes corresponding at least substantially to the shapes of upper and lower surfaces of said package;

means for feeding an upper sheet of packaging material into said batt stacking space between said stack and said upper compression surface;

means for feeding a lower sheet of packaging material into said batt stacking space between said stack and said lower compression surface;

means for effecting relative vertical displacement of said upper and lower compression means to compress said stack therebetween;

means for sealing together edge portions of said upper and lower sheets to form a retaining covering around the compressed stack;

said means for effecting relative vertical displacement being reversible to remove said upper compression surface from said stack and thereby to release said compressed stack for expansion against said retaining covering; and means for displacing said released compressed stack and its covering from said lower compression surface.

7. Apparatus as claimed in claim 6, wherein said upper and lower concave compression surfaces are cylindrically curved and each have a radius of curvature lying within the range $\frac{1}{2}$W to 3W, where W is the width of said insulation batts.

8. Apparatus as claimed in claim 7, wherein said radius of curvature is approximately $\frac{5}{8}$W.

9. Apparatus as claimed in claim 6, further comprising a batt support member mounted for horizontal displacement into and from said batt stacking space and above said lower compression means;

means for effecting the horizontal movement of said batt support member;

means for withdrawing said batt support means from said batt stacking space at said location upon displacement of said batt support member into said location to transfer said stack of batts from said batt support means to said batt support member, said lower sheet feeding means being provided at a level between said location and said lower compression means.

10. Apparatus as claimed in claim 6, further comprising auxiliary compression means for compressing a first portion of said stack in said batt stacking space and supporting a remainder of said stack during compression thereof by said upper compression means, and means for withdrawing said auxiliary compression means horizontally outwardly of said batt stacking space from between said compressed first portion and said remainder of said stack to unite said stack.

11. Apparatus as claimed in claim 6, wherein said upper compression means comprises a pair of upper compression members, said apparatus further comprising drive means for displacing said pair of upper compression members downwardly in succession through said batt stacking space for compressing respective successive stacks of said batts.

12. Apparatus as claimed in claim 9, wherein said batt support means comprise an upwardly facing support surface on said upper compression means.

13. Apparatus as claimed in claim 9, wherein said lower compression means are vertically displaceable towards said batt support member into a raised position for receiving said stack from said batt support member upon withdrawal of said batt support member from said batt stacking space.

14. Apparatus as claimed in claim 9, wherein said batt support means are provided on each of said upper compression means with a space between each batt support means and its respective upper compression means for receiving said batt support member therebetween at said location.

15. Apparatus as claimed in claim 14, wherein said lower compression means are vertically displaceable towards said batt support member into a raised position for receiving said stack from said batt support member upon withdrawal of said batt support member from said batt stacking space.

* * * * *

UNITED STATES PATENT AND TRADEMARK OFFICE

CERTIFICATE OF CORRECTION

PATENT NO. : 4,953,344

DATED : September 4, 1990

INVENTOR(S) : Wallace

It is certified that error appears in the above-identified patent and that said Letters Patent is hereby corrected as shown below:

Column 1, line 31, delete "Eistinghousen" and insert therefor --Wistinghausen--;
line 42, delete "is" and insert therefor --it--.
Column 2, line 68, after "apparatus", insert --for--.
Column 11, line 34, before "member", insert --compression--;
line 36, before "member", insert --compression--;
delete "37" and insert therefor --36a--.
line 39, delete "37" and insert therefor --36a--.
Column 12, line 49, delete "and lower".
Column 16, line 62, after "space", insert the following --at a location near the bottom of said batt stacking space--.

Signed and Sealed this

Twenty-first Day of April, 1992

*Attest:*

HARRY F. MANBECK, JR.

*Attesting Officer*

*Commissioner of Patents and Trademarks*